United States Patent [19]

Kreuzer et al.

[11] 4,126,312

[45] Nov. 21, 1978

[54] RADIO-CONTROLLED SURFACE TARGET HAVING A PLIABLE COVER

[75] Inventors: John A. Kreuzer, Mission Viejo; John F. Gothard, Jr., El Toro, both of Calif.

[73] Assignee: Brunswick Corporation, Skokie, Ill.

[21] Appl. No.: 764,704

[22] Filed: Feb. 1, 1977

[51] Int. Cl.[2] ..... F41J 9/02

[52] U.S. Cl. ..... 273/105.2; 35/25; 89/36 H; 180/98

[58] Field of Search ..... 35/25, 11 R; 180/27, 180/98; 89/1 E, 1 A, 36 R, 36 H; 102/19; 46/254, 9, 87-89, 210, 222, 223; 273/105.2, 105.6, 102.1 G, 102.1 R, 102.1 C, 102.3, 105.3, 105.4, 105.5

[56] References Cited

U.S. PATENT DOCUMENTS

| | | | |
|---|---|---|---|
| 2,164,340 | 7/1939 | Morgan et al. | 273/105.2 |
| 2,334,539 | 11/1943 | Buchtel | 35/25 |
| 2,805,065 | 9/1957 | Cotton | 273/105.3 |
| 3,128,096 | 4/1964 | Hammond et al. | 273/105.6 X |
| 3,411,778 | 11/1968 | Barry | 273/105.4 |
| 3,595,436 | 7/1971 | Huskvarna | 273/102.1 C X |
| 3,815,260 | 6/1974 | Heaton | 35/11 R |
| 3,917,270 | 11/1975 | Gothard et al. | 273/105.2 |

*Primary Examiner*—William H. Grieb
*Attorney, Agent, or Firm*—Finnegan, Henderson, Farabow & Garrett

[57] ABSTRACT

A mobile surface target including a target envelope mounted on a chassis, the envelope having the appearance of a ground vehicle and including a framework and a pliable cover for permitting quick repair. The pliable cover preferably is plastic and inflatable in individual sections, which may be filled with "smoke" for recognition of a hit. The target is radio-controlled and an armored shield is mounted on the chassis of the target under the envelope for protecting the radio-signal receiving and transducing control equipment and the running gear of the target from damage by weapons.

19 Claims, 6 Drawing Figures

Fig. 1
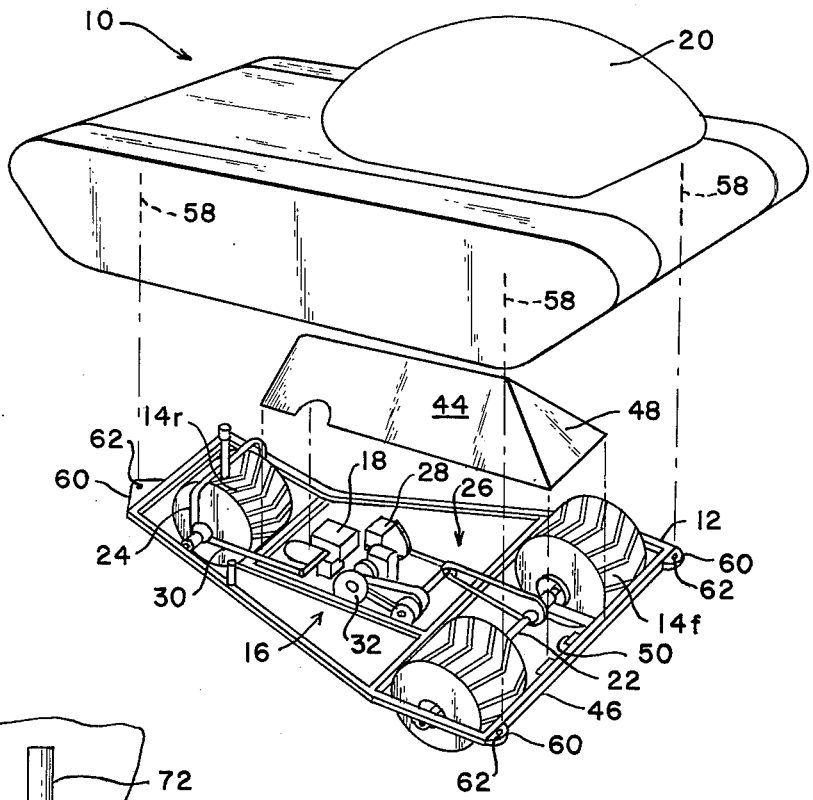
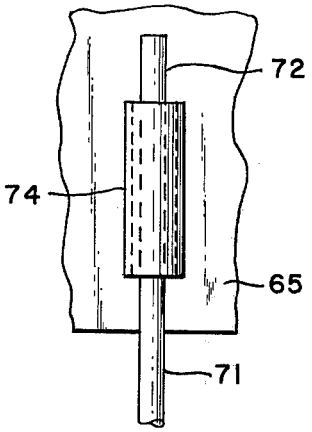
Fig. 5a
Fig. 5b
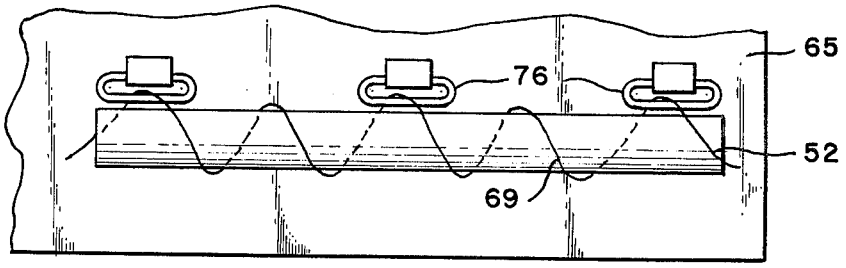

RADIO-CONTROLLED SURFACE TARGET HAVING A PLIABLE COVER

BACKGROUND OF THE INVENTION

1. Field of the Invention

This invention relates to a radio-controlled surface target and more particularly to a target envelope for a ground target meant to give a simulation of various threats for air-to-ground and ground-to-ground weapons training and evaluation.

2. Background of the Invention

A requirement exists in the government inventory of training devices for a low-cost, realistic moving target for air-to-ground and ground-to-ground weapons delivery training. Typically prior art targets are surplus vehicles modified for remote control operation. Particular problems with these targets include the initial high cost, the difficulty in obtaining spare or replacement targets, the high labor maintenance cost, the heavy weight of the vehicles and poor fuel economy.

Further, where the armored targets are used it is difficult to score hits and misses satisfactorily which requires that a large number of people be employed on the weapons range to evaluate performance during training and testing missions.

More recently a radio-controlled target has been developed utilizing an envelope having the appearance of a ground vehicle, the envelope being composed of lightweight frangible material for quick replacement, the envelope usually being destroyed upon a hit.

SUMMARY OF THE INVENTION

Accordingly, it is the primary object of this invention to provide an improved radio-controlled target in which the envelope can be repaired or portions of the envelope inexpensively and quickly replaced upon a hit.

It is also an object of this invention to make remotely controlled ground targets self-scoring as to a "hit."

Additional objects and advantages of the invention will be set forth in part in the description which follows, and in part, will be obvious from the description or may be learned from practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, there is provided a ground target for simulating moving ground vehicles which includes vehicle chassis means, means affixed to the chassis means for propelling and maneuvering the target, means mounted on the chassis means for receiving and transducing radio signals for controlling the propelling and maneuvering means, armor means disposed on the chassis means for protecting the propelling and maneuvering means and the radio signal receiving and transducing means, and a target envelope having the appearance of the upper portion of a ground vehicle, the target envelope including a pliable cover means for permitting quick repair of the target envelope.

Preferably the target envelope is a lightweight structure that can be readily configured into one of a number of desired shapes and can be easily and quickly assembled and disassembled.

Further, the target envelope, as embodied herein, comprises a framework of tubular steel covered with pliable material such as polyester-vinyl, in which holes and tears may be easily repaired by patching, or an inflatable body, preferably in sections, for quick replacement and easy reconfiguration. The inflatable sections may be formed, for example, from vinyl.

It is also preferred that the inflatable sections be filled with "smoke" to provide a "score" when hit.

The invention consists in the novel parts, constructions, arrangements, combinations, and improvements shown and described. The accompanying drawings, which are incorporated in and constitute a part of this specification, illustrate one embodiment of the invention, and, together with the description, serve to explain the principles of the invention.

BRIEF DESCRIPTION OF THE DRAWINGS

Of the drawings:

FIG. 1 is an exploded, perspective view of a target vehicle incorporating the target envelope of the present invention;

FIGS. 5*a* and 5*b* show structure for attaching the pliable cover to the framework of the envelope of FIGS. 3 and 4.

DESCRIPTION OF THE PREFERRED EMBODIMENT

Figure 2:
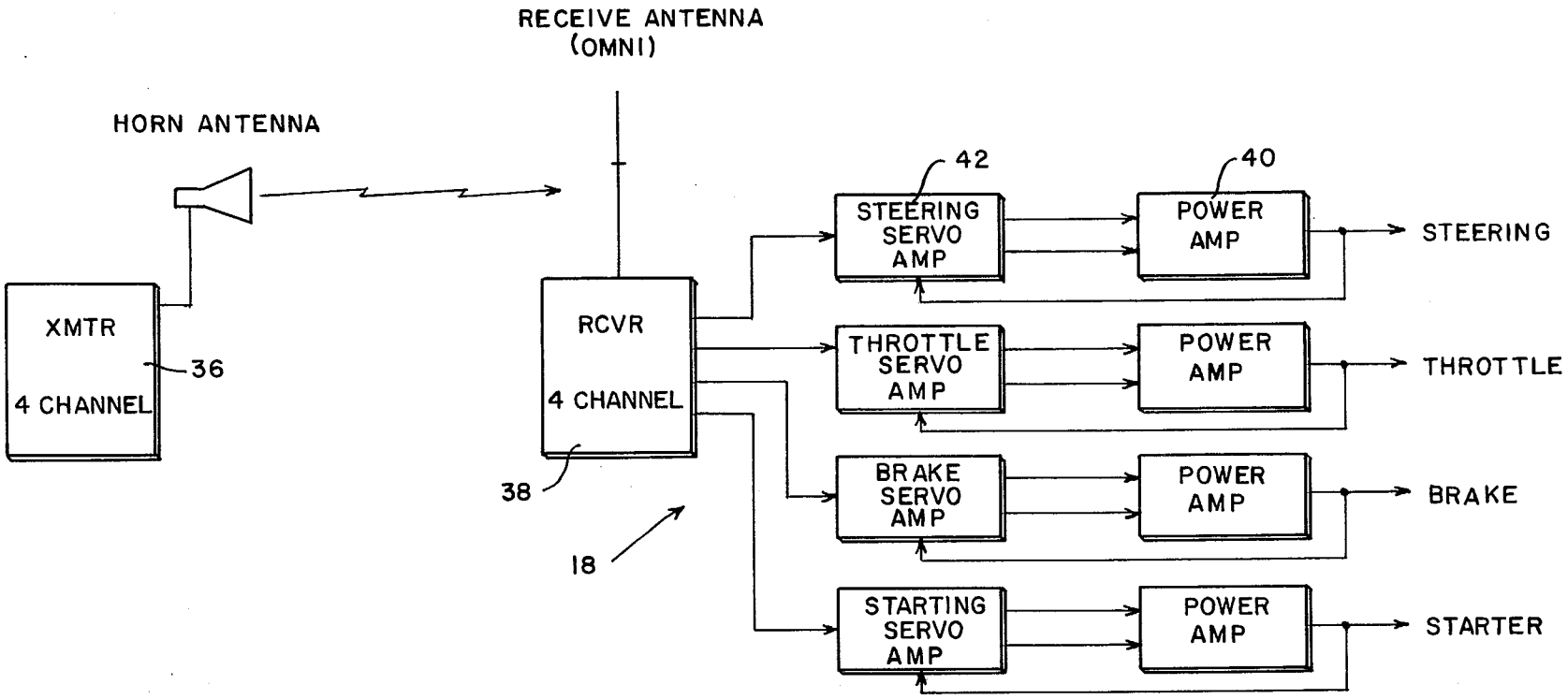
FIG. 2 is a block diagram of the means for receiving and transducing radio signals and controlling the propelling and maneuvering apparatus of the target vehicle.

Reference will now be made in detail to the present preferred embodiment of the invention, an example of which is illustrated in the accompanying drawings.

Referring now to FIG. 1, the target 10 for simulating moving ground vehicles in its preferred embodiment comprises a frame or chassis 12 having wheels 14 disposed thereon, running gear 16 affixed to said frame 12 for operating and maneuvering the target 10, means 18 for receiving radio signals and controlling the running gear and a target envelope 20. The frame 12 utilizes an axle 22 to mount the front wheels 14*f* and wishbone fork 24 to mount the rear steering wheel 14*r*. Although a three-wheel target vehicle is illustrated, a four-wheel vehicle or the like may also readily be used to accomplish the objects and advantages of the present invention.

As here embodied and best seen in FIG. 1, running gear 16 operates and maneuvers the target 10 and includes the conventional elements of a drive train 26 having an engine 28 for driving the wheels 14 at variable speeds and a steering mechanism 30. Typically, the drive train 26 uses a small industrial internal combustion engine 28 which is chain-connected through a transmission 32 to provide power to the wheels 14. A suitable engine 28 is a Tecumseh 10 horsepower engine which provides sufficient power to propel the target in excess of speeds of 20 miles per hour and provides economy better than 50 miles per gallon. A battery-driven electric motor may also be used as the prime mover in the drive train 26.

The transmission 32 is preferably a torque-sensitive, variable speed automatic transmission to provide great flexiblity in range and speeds of the target. The steering mechanism 30 is a "tiller" type device and the hardware and components of the running gear 16 are well known in the art of "golf cart" technology.

As may be seen in FIG. 2, the means 18 for receiving radio signals and controlling the running gear 16 preferably uses conventional, commercial electronics. A transmitter 36 located at a radio control tower (not shown) sends signals to a receiver 38 mounted on the frame 12 of the target vehicle. Both the transmitter 36 and receiver 38 can be commercially available remote control units routinely used by hobbyists and the like in controlling model airplanes, boats and cars. This relatively inexpensive remote-control equipment, coupled with a high gain horn antenna at the transmitter 36 can provide a sufficient gain for operation of targets over a mile away.

As embodied herein, means 18 provides the function of remote steering, remote throttling, remote starting and remote braking. As illustrated in detail in FIG. 2, each remote control function of steering, throttling, starting and braking preferably includes receiver 38, power amplifier 40, servo amplifier 42 and prime mover (not shown). Typically, the prime mover actuates a mechanical actuator (not shown) or the like, the position of which is controlled by a position feedback pot situated between an upper and lower range adjustment device. In this manner, the running gear 16 for operating and maneuvering the target 10 is remotely controlled by radio signals. The components of the receiving and controlling means 18 are well known in the electronics art, and are not considered to be a part of this invention.

An armored shield 44 is designed to protect running gear 16 and means 18 from damage caused by weapon impact or explosion and is affixed to a cross brace 46 of frame 12 by suitable mechanical means as hinges or the like. The envelope 20 is expected to become damaged during target practice. The rest of the target 10, however, in particular, apparatus such as the engine 28, transmission 32, drive train 26, steering mechanism 30, radio signal receiving and transducing means 18 and the like are relatively expensive and are protected from damage by use of armored shield 44.

As herein embodied and illustrated in FIG. 1, the armored shield 44 is positioned under the target envelope 20 and covers the maneuvering apparatus, together with the signal receiving and target controlling means 18. This shield is of selected standard armored plate, well known to those skilled in the art, and provides protection to the above components from damage by weapons. As embodied herein, the shield walls 48 are structured so as to define curved, slanted, or inclined surfaces, thereby providing a surface which readily deflects weapon fragments and projectiles. Preferably, the shield 44 is positioned on frame cross bar 46 by hinges 50 so as to be easily raised from the frame 12 to allow quick access to the running gear 16 and the signal receiving and target controlling means 18.

In accordance with the invention, the surface target 10 includes an envelope 20 having a pliable cover over a lightweight framework. The pliable cover is preferably formed of plastic and easily repairable, and the framework can be assembled and disassembled with replaceable parts.

Figure 3:
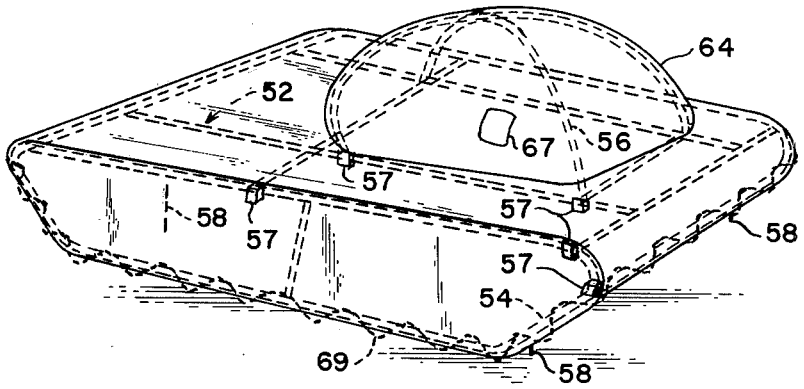
FIG. 3 is a perspective view of one embodiment of the target envelope of the present invention.

As embodied herein, and depicted in FIG. 3, the framework 52 of envelope 10 is assembled from specialized sections such as a tank caterpillar section 54, or a tank turret section 56, and rods or bars of various lengths. The specialized individual sections may be shaped by welding together steel tubing or flat bars, for example, and the individual sections may be interconnected by the rods or bars. The various parts of framework 52 may be rigidly interlocked by quick disconnect clamps 57. Such clamps are well known and need not be detailed here.

The framework 52 is provided with supports 58 in the form of studs for slidably mounting on the chassis 12 of the target vehicle by means of tabs 60 on the chassis and having apertures 62 therein.

In the preferred embodiment in FIG. 3, the framework 52 is covered with a pliable cover 64, preferably formed of 10 ounce polyestervinyl fabric. The cover 64 is shaped to slide over the framework 52 and the bottom edge may be lashed to the framework 52 by lacing 69 such as used for fitted car covers, as described as to FIG. 5*b*.

Air vent flaps 67 may be formed in the pliable cover 64, as desired, to allow heated air to escape and thus to provide better ventilation for the engine and electronic elements.

Holes and tears on the pliable cover 64 can easily be repaired by self-adhesive tape or by sew-on patches. The cover 64 extends down only over the sides of the target vehicle leaving the bottom area of the vehicle uncovered for ventilation of the engine and electronic equipment.

In case of damage to the framework 52, repairs can easily be made by replacement of rods or bars, or by welding the pre-assembled sections. Tubular steel provides maximum strength for weight and is easily welded in repair operation.

The total weight of the envelope 20 is at a minimum, thereby enhancing vehicle performance without sacrificing the strength and rigidity that are necessary for rough terrain vehicles.

It is understood, of course, that the target envelope 20 of the targe vehicle may take any form, such as a motorized gun or rocket launcher, and the framework 52 would be assembled from sections and rods and bars to present the appearance of appropriate target.

It is also apparent that, in accordance with the invention, the appearance of the target envelope may be made as detailed as desired by adding to the framework 52 and the pliable cover 64 various identifying elements, such as field guns, machine guns, air vents, etc.

Figure 4:
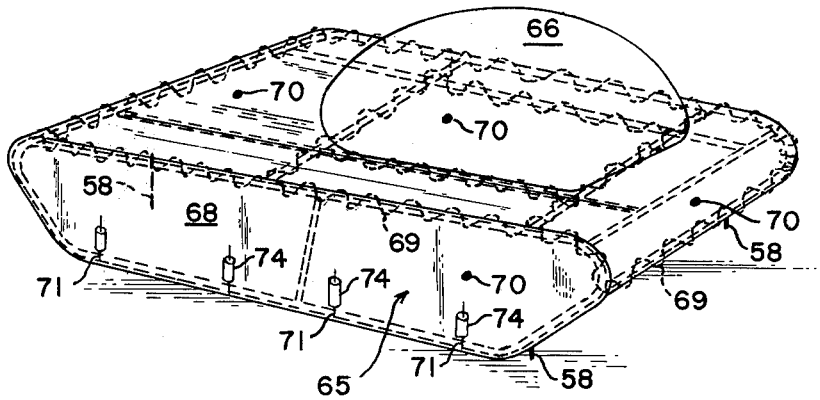
FIG. 4 is a perspective view of another embodiment of the target envelope of the present invention.

In accordance with the invention in an alternative embodiment as shown in FIG. 4, the pliable cover 64 may be formed of inflatable sections. each fitted with an air valve 70. Several such inflatable sections may be incorporated in an integral cover, or preferably, the cover 64 may be divided into individual inflatable segments 65, each of which is separately attachable to the framework 52.

As embodied herein, a turret section 66 is an individual inflated section attached to the framework 52. Likewise, the section 68, having the appearance of caterpillar tractor may, for example, be an individual section. The pliable cover 64 may be further divided into individual inflatable sections, as convenient to the particular target involved.

The individually inflatable segments 65 will, of course, have air tight inner and outer walls preferably formed of 8 mil thick aluminum-filled virgin vinyl. Such fabric has the advantage of making the target envelope radar reflective.

By the use of individual, inflatable segments, damaged portions of the target envelope may be quickly replaced without the necessity of replacing the entire cover.

The individual inflatable segments 65 may be attached to the framework 52 by any known means. As embodied herein, the framework 52 may include short bars or pipes 71, as shown in FIG. 5*a*, having a free end 72. The segment 65 may have attached thereto a tunnel member 74 through which the free end 72 of the bar 70 is inserted for holding the segment 65 to the framework. The tunnel members 74 may be conveniently fused to the segments 65. Such a mounting design has particular utility, for example, at the lower end of a vertical segment.

Additionally, the segment 65 may be provided with D-rings 76 which are attached to the segments by any convenient method. The segment 65 may then be mounted on the framework 52 by lacing 69 through the D-rings 76.

In accordance with the invention, the inflatable segments 65 may be filled with "smoke", such as a gas containing a colorful substance so that a "hit" can be immediately verified and the "hit" on the target is self-scoring. Such "smoke" is well known and need not be further amplified herein. The segment 65 punctured by a missile can be quickly replaced and the target 10 be immediately ready for scoring additional hits.

It will be apparent to those skilled in the art that various modifications and variations could be made in the mobile surface target of the invention without departing from the scope or spirit of the invention.

What is claimed is:

1. A target simulating a moving ground vehicle comprising:

vehicle chassis means;

means affixed to said chassis means for propelling and maneuvering said chassis means;

radio signal receiving and transducing means mounted on said chassis means for controlling said propelling and maneuvering means;

armor means disposed on said chassis means for protecting said propelling and maneuvering means and said controlling means; and a target envelope having the appearance of the upper portion of a ground vehicle, said target envelope including a plurality of individual inflatable components and a framework of rigid support members, each of said components being separately attached to said framework.

2. The target of claim 1 including means for disassembling said framework into a plurality of component parts.

3. The target of claim 1 wherein said individual inflatable components include means for mounting said inflatable components on said framework.

4. The target of claim 1 wherein said mounting means includes D-rings fixed to the inflatable components for lashing the inflatable components to the framework.

5. The target of claim 1 wherein said plurality of individual inflatable components are fabricated from radar-reflective material.

6. The target of claim 5 wherein said radar reflective material is aluminum-filled vinyl fabric.

7. The target of claim 1 wherein said individual inflatable components contain "smoke" for identifying a "hit" on the component.

8. A target simulating a moving ground vehicle comprising:

vehicle chassis means;

means affixed to said chassis means for propelling and maneuvering said chassis means;

radio signal receiving and transducing means mounted on said chassis means for controlling said propelling and maneuvering means;

armor means disposed on said chassis means for protecting said propelling and maneuvering means and said controlling means;

a target envelope having the appearance of the upper portion of a ground vehicle, said target envelope including a plurality of individual inflatable components and a framework of rigid support members; and means for disassembling said framework into a plurality of component parts, said parts including short members having free ends and said individual inflatable components including tunnels of material attached thereto for sliding over said free ends.

9. The target of claim 8 wherein said tunnels of material are attached by fusing.

10. A target simulating a moving ground vehicle comprising:

vehicle chassis means;

means affixed to said chassis means for propelling and maneuvering said chassis means; and a target envelope mounted on said chassis means, said envelope having the appearance of the upper portion of a ground vehicle and including pliable cover means comprising a plurality of individual inflatable components for permitting quick repair of the envelope, and including a plurality of rigid support members for said pliable cover means, each of said components being separately attached to at least one of said rigid support members.

11. The target of claim 10 wherein said plurality of rigid support members includes a plurality of welded steel tubes.

12. The target of claim 10 wherein said pliable cover means is formed substantially from polyester vinyl fabric.

13. The target of claim 10 including means for disassembling said plurality of support members into a plurality of component parts.

14. The target of claim 10 wherein said individual inflatable components include means for mounting said inflatable components on said support members.

15. The target of claim 10 wherein said plurality of individual inflatable components are fabricated from radar-reflective material.

16. The target of claim 15 wherein said radar-reflective material is aluminum-filled vinyl fabric.

17. The target of claim 10 wherein said individual inflatable components contain "smoke" for identifying a "hit" on the component.

18. A target simulating a moving ground vehicle comprising:

vehicle chassis means;

means affixed to said chassis means for propelling and maneuvering said chassis means;

a target envelope mounted on said chassis means, said envelope having the appearance of the upper portion of a ground vehicle and including pliable cover means comprising a plurality of individual inflatable components for permitting quick repair of the envelope, and also including a plurality of rigid support members for said pliable cover means; and means for disassembling said plurality of support members into a plurality of component parts, said parts including short members having free ends and said individual inflatable components including tunnels of material attached thereto for sliding over said free ends.

19. The target of claim 18 wherein said tunnels of material are attached by fusing.

* * * * *